US006675621B2

(12) United States Patent
Kleber

(10) Patent No.: US 6,675,621 B2
(45) Date of Patent: Jan. 13, 2004

(54) PLURAL SHEET SUPERPLASTIC FORMING EQUIPMENT AND PROCESS

(75) Inventor: Richard Murray Kleber, Clarkston, MI (US)

(73) Assignee: General Motors Corporation, Detroit, MI (US)

( * ) Notice: Subject to any disclaimer, the term of this patent is extended or adjusted under 35 U.S.C. 154(b) by 99 days.

(21) Appl. No.: 09/950,229

(22) Filed: Sep. 10, 2001

(65) Prior Publication Data

US 2003/0046966 A1 Mar. 13, 2003

(51) Int. Cl.[7] ..... B21D 26/02
(52) U.S. Cl. ..... 72/60; 72/56; 72/57; 29/421.1
(58) Field of Search ..... 72/57, 58, 59, 72/60, 61; 29/890.042

(56) References Cited

U.S. PATENT DOCUMENTS 2,728,317 A * 12/1955 Clevenger et al. ..... 72/60
3,512,239 A * 5/1970 Rosenblad ..... 29/890.042
3,837,200 A * 9/1974 Wolbert ..... 72/57
3,920,175 A * 11/1975 Hamilton et al. ..... 228/173.2
4,181,000 A * 1/1980 Hamilton et al. ..... 72/60
4,301,584 A * 11/1981 Dillner et al. ..... 29/889.71
4,632,296 A * 12/1986 Mansbridge et al. ..... 228/157
5,449,109 A * 9/1995 Chuang et al. ..... 228/157
5,711,059 A * 1/1998 Schaefer ..... 29/423
5,819,572 A 10/1998 Krajewski ..... 72/42
5,974,847 A 11/1999 Saunders et al. ..... 72/57
6,047,583 A 4/2000 Schroth ..... 72/60
6,266,986 B1 * 7/2001 Morita et al. ..... 72/58
6,301,765 B1 * 10/2001 Arns et al. ..... 29/421.1

* cited by examiner

*Primary Examiner*—Allen Ostrager
*Assistant Examiner*—John S Goetz
(74) *Attorney, Agent, or Firm*—Kathryn A. Marra

(57) ABSTRACT

Superplastic forming tools and method in which pairs of stacked metal blanks are serially loaded between heated forming dies that are moved to a closed position on each of the pair of blanks so that a partial perimeter gas seal is established therebetween. A pressure wedge is then introduced between the two blanks along one edge of the pair to act as a stopper or air seal to complete perimeter sealing thereof. The pressure wedge also establishes the operative position of a gas injection port, which directs pressurized air interiorly of the completed perimeter seal of the pair of blanks to force the blanks in opposite direction for the superplastic forming of a pair of discrete parts. The wedge and forming dies are then opened for the removal of a pair of formed parts and for the subsequent loading of additional pairs of stacked sheets for their simultaneous superplastic forming into pairs of parts. With this construction and process, the output of superplastic forming equipment can be multiplied for improved efficiency and for improved formation of parts.

7 Claims, 3 Drawing Sheets

PLURAL SHEET SUPERPLASTIC FORMING EQUIPMENT AND PROCESS

TECHNICAL FIELD

This invention relates to the manufacture of parts using sheet metal forming blanks and forming dies and more particularly to new and improved superplastic forming die constructions and techniques for the simultaneous superplastic forming of metallic blanks into a plurality of formed parts.

BACKGROUND OF THE INVENTION

Prior to the present invention, various types of superplastic forming equipment and processes have been developed for forming blanks of metallic materials into a wide range of items. The forming dies for such equipment and processes are operated in presses that are capable of maintaining elevated temperatures necessary for superplastic forming. Such temperature elevation increases the capability of the metal for strain induced deformation and reduces the force required for that deformation. A time controlled compressed air charge is typically delivered to the forming equipment to apply the force on the heated metal blank to super plastically form the metal on the forming die.

In more specific detail relative to the present invention, superplastic forming involves the employment of a blank ductile sheet of superplastic metal alloy heated by heat energy sustained in a heated press and stretched by the applied force of compressed air onto the forming surfaces or into forming cavities of heated forming dies to produce high-quality, light-weight parts such as panels for automotive vehicles. Often such sheets are quite large so that trunk lids, engine hoods or other large panels can be readily formed in one piece.

Examples of such processes and equipment are found in U.S. Pat. No. 5,974,847 issued Nov. 2, 1999 to Sanders et al for Superplastic Forming Process; U.S. Pat. No. 5,819,572 issued Oct. 13, 1998 to P. E Krajewski for Lubricating System For Hot Forming and U.S. Pat. No. 6,047,583 issued Apr. 11, 2000 to G. L. Schroth for Seal Bead For Superplastic Forming of Aluminum Sheet, all assigned to the assignee of this invention and hereby incorporated by reference.

In the patent to Sanders et al. a blank of sheet of metal alloy is heated to a superplastic forming temperature and is pulled over and around a forming insert in a die set. Subsequently using differential gas pressure, the blank is further stretched into conformity with a forming surface of the insert so that thinning of the formed part is minimized. In the patent to Krajewski, dry lubricant is applied to a sheet metal blank which is subsequently heated to predetermined forming temperatures and formed into a part in superplastic forming die equipment. The lubricant initially provides improved forming of the part and subsequently improved release of the formed part from the forming die. In the patent to Schroth a new and improved seal bead construction is provided for superplastic forming tools to improve gas sealing in the tools for augmenting subsequent superplastic stretch forming of the sheet metal blank.

While the above identified patent disclosures provide improvements in superplastic forming they often do not attain new and higher production output and quality standards required for mass production of such formed parts.

SUMMARY OF THE INVENTION

In contrast the prior art, the present invention increases superplastic forming production rates by providing for the simultaneous formation of at least two sheets of superplastic forming blanks into two separate parts from the same pressurization. In one preferred embodiment, a lower superplastic formable blank is placed onto a lower die half of a pair of heated superplastic forming die. An upper superplastic formable blank is placed directly on top of the lower blank or panel. A heated upper die half is moved under load onto the upper blank to effect partial fluid sealing at predetermined peripheral interface areas to define a partially sealed air space between the blanks. A pressurization wedge is moved from one side of the overlying sheets to a fluid sealing or stopper position between the sheets and in which a forward edge portion of the upper sheets is displaced upwardly to define a gas entry way between the two blanks and to complete the pressure sealing of the air space between the blanks. Pressurized air or other inert gas is fed through at least one fluid conducting passage formed through the wedge and within the bounds of the pressure sealing of the two heated sheets that effects the simulations displacement of the sheets from one another onto the forming dies to form the two discrete parts.

More particularly, the lower forming blank is sized and initially placed in such a manner that it rests on the lower die half below the leading edge of the pressurization wedge of the equipment of this invention. The upper forming blank is longer than the lower forming blank and when positioned directly on top of the lower forming blank, drapes onto or over the pressurization wedge. The upper and lower forming blank may be loaded on the forming die as a pair of panels or blanks. The clamping of the blanks between the die halves such as by closing operation of a press effects partial internal and perimeter fluid sealing of the blanks and subsequent movement of the pressurization wedge into an air tight or stopper position between the two blanks completes the perimeter sealing required for the following pressurization of the panels for the forming step of the cycle. Pressurized air or other inert gas is fed through at least one fluid flow feed passage extending through the pressurization wedge terminating at points interior of the continuous air seal provided between the overlying sheets and the pressurization wedge forced between the two sheets. The heated blanks are then displaced by the force of the expanding gas introduced between the blanks in opposite directions around or into the forming surfaces of the opposing and closed upper and lower dies. Two high quality superplasticly formed parts are produced from a single air charge. The opened dies can then be quickly prepared to make subsequent pairs of parts in additional cycles.

The equipment of this invention provides improved superplastically formed parts and improved production rates of superplastically formed parts. This invention importantly meets higher standards for quantity production of high quality parts superplastically formed from metallic sheets or blanks operatively mounted in hot forming dies particularly using a press and operating at elevated temperatures.

It is a feature, object and advantage of this invention to provide new and improved equipment and methods to produce superplastically formed parts in which a common pressurized gas is introduced between heated blanks, fluid sealed with respect to one another for superplastic forming to displace the blanks away from one another within forming dies to simultaneously form discrete parts reproducing the form set by the upper and lower profiled forming surfaces.

In one preferred form of the invention, the equipment comprises upper and lower forming dies for superplastically forming sheet metal blanks operatively mounted therebetween and further comprises a blank positioning and air sealing wedge positioned so that it operatively fits between portions of the blanks for the fluid sealing thereof. The wedge importantly establishes the position of an air discharge port for the delivery of a pressurized forming gas therebetween to plastically force the blanks in opposite directions around the profiling surfaces of the forming dies.

BRIEF DESCRIPTION OF THE DRAWINGS

These and other objects, advantages and features of the invention will become more apparent from the following detailed description of one preferred embodiment of the invention and drawing in which.

DESCRIPTION OF THE PREFERRED EMBODIMENT

Figure 1:
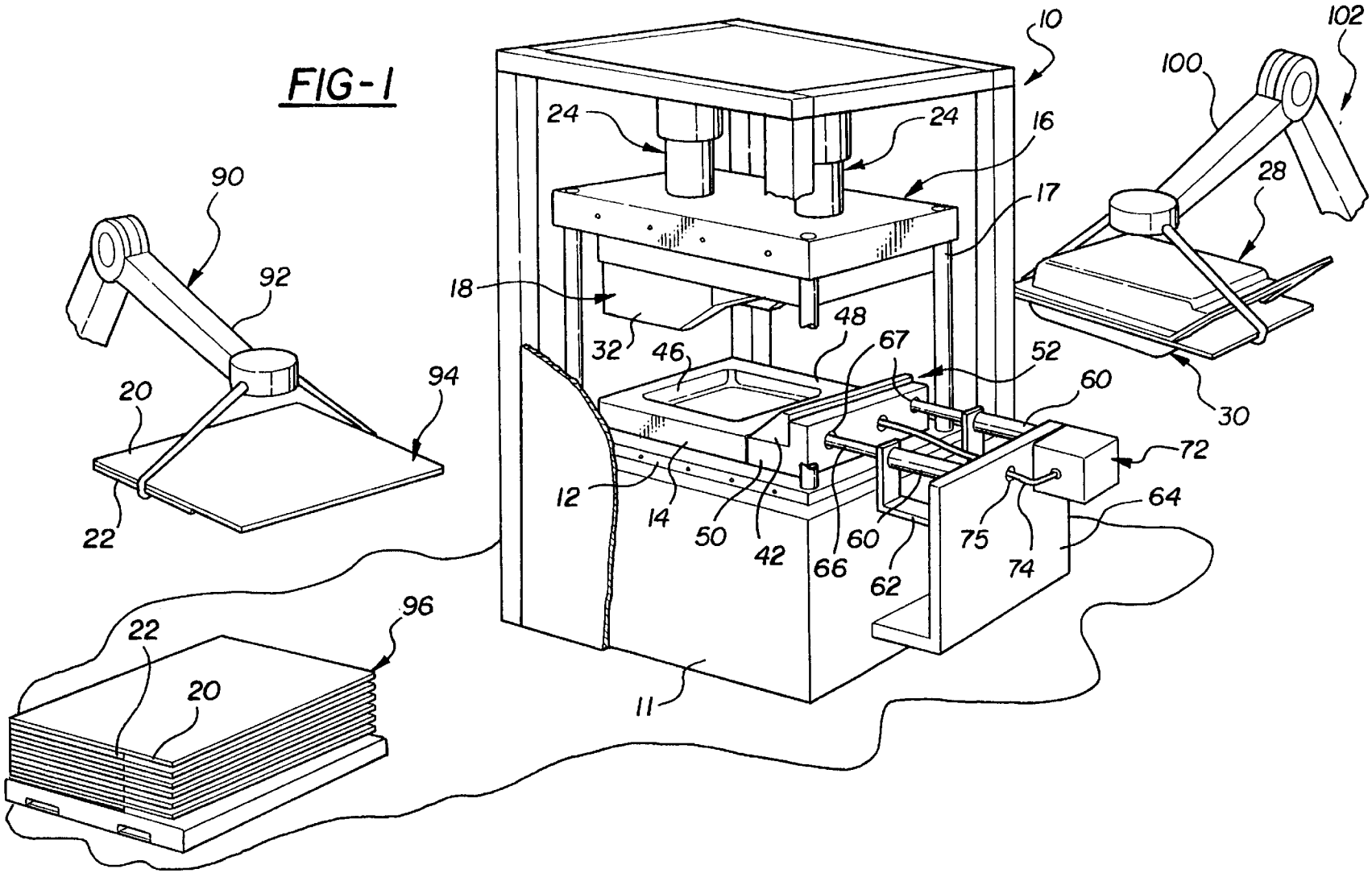
FIG. 1 is a pictorial view of superplastic forming equipment according to this invention for simultaneously forming pairs of sheet metal blanks into plurality of formed parts.

Turning now in greater detail to the drawing, FIG. 1 illustrates a forming press 10 comprising a base member 11 supporting a lower bolster plate 12 on which lower tool or forming die 14 is mounted. The press additionally has an upper carrier plate 16 operatively mounted for reciprocating movement on upstanding rails 17 extending from the base member. The carrier plate 16 securely mounts the upper tool or forming die 18, which projects downwardly therefrom. Both plates 12 and 16 are electrically heated to establish the required heat energy levels in the upper and lower forming dies and the upper and lower sheet metal blanks 20, 22 loaded therein for super plastic forming.

The upper carrier plate 16 of the press and the forming dies are cycled by hydraulic cylinders 24 operatively mounted between the stationary top of the press and the carrier plate 16. The cycle may be from the illustrated open press position shown in FIG. 1 for loading of the two sheet metal blanks to the closed position shown in FIG. 3 for forming of the blanks into two discrete parts and then back to the open position for removal of the formed parts from the hot forming dies. A second pair of blanks can then be loaded into the forming dies for another cycle to form additional parts. The blanks utilized with one preferred embodiment of this invention are flattened rectilinear sheets of aluminum alloy coated with a dry lubricant such boron nitride to function as an agent to enhance the stretching and forming of the parts 28, 30 during super plastic forming operation and as a release agent to prevent the formed parts 28,30 from adhering to the associated forming dies. Other than having the upper blank sized to have a length slightly greater than the length of the lower blank to fill the dies no extensive preparation of the forming blanks is required.

As best shown in FIG. 1 the upper tool 18 is operatively connected to the upper carrier plate and projects downwardly therefrom. This tool has a downwardly extending and generally rectilinear peripheral wall 32 that may encompass a forming insert therein. However, in the illustrated embodiment, the interior of the upper forming die is a smooth and continuous inner forming surface 34 to define a profiling cavity 36. A forward side 38 of the peripheral wall 32 is formed with a inclined and flattened contact surface 40 that defines a discrete entry way 44 leading into the forming cavity 36. This contact surface 40 further provides a stationary backing for engagement with the upper surface of a leading edge portion 41 of the upper sheet metal blank 20 during superplastic forming. However, when the upper blank is initially loaded into the forming dies, the leading edge portion 41 thereof drapes across an air-sealing pressure wedge 42 of the super plastic forming equipment.

The lower tool or forming die 14 extends upwardly from support by the bolster plate 12 and has a rectilinear peripheral wall whose inner surface defines the forming wall of the forming cavity 46 of the lower tool 14. This wall has a flattened top surface 48 that contacts and supports the lower sheet metal blank 22 when loaded into the forming dies.

The pressure wedge 42 is operatively mounted for sliding movement on an extending leg 50 of a support block 52, L shaped in cross section and secured to the bolster plate 12. The extending leg 50 of the support block has an upper planar support surface 56 that contacts and slidably supports the pressure wedge as illustrated best in FIGS. 2*a* and 3*a*. This support surface 56 is slightly higher in elevation relative to the top surface 48 of the lower forming die so that the forward edge of the blank 22 can abut against the forward wall of the support block to augment blank positioning. In addition, the upper surface of support surface 56 is coplanar with the upper surface of the lower blank to augment stroking movement of the pressure wedge to and from its closed position. More particularly, this alignment of support surfaces allows the pressure wedge 42 to easily slide and move from the top surface of the support block onto the upper surface of the sheet metal blank 22 to a closed and air sealing position subsequent to closure of the forming dies.

Figure 3:
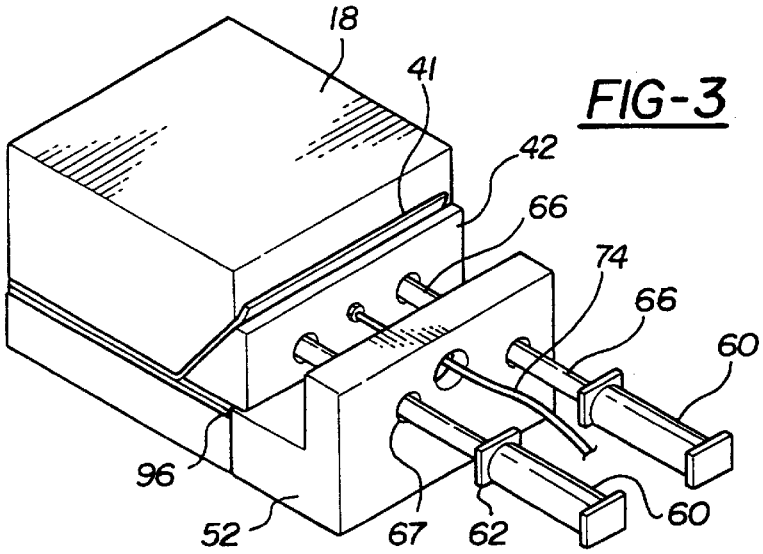
FIG. 3 is a pictorial view similar to the view of FIG. 2 illustrating a moved position of the pressurization wedge.
Figure 3A:
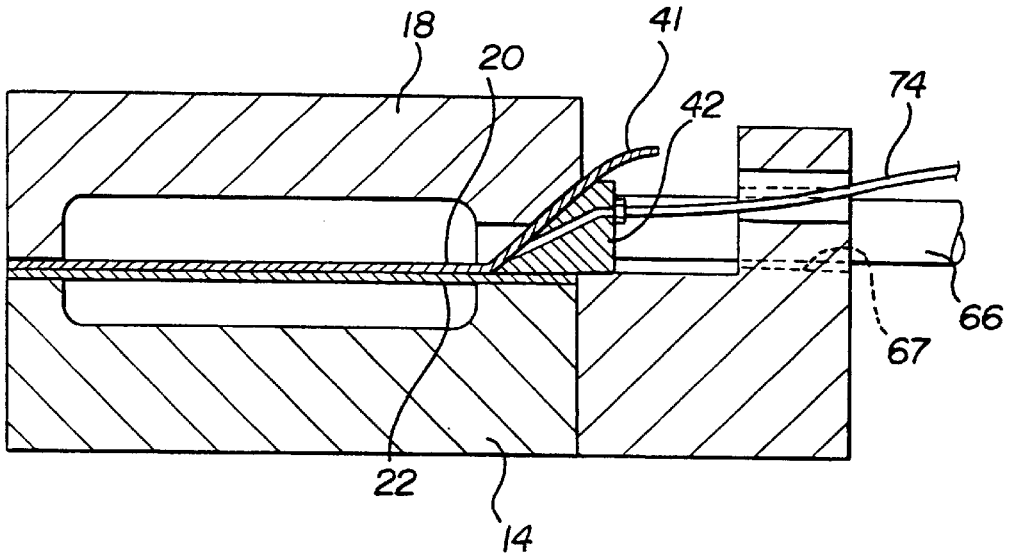
FIG. 3*a* is a cross sectional view of the construction of FIG. 3.

The pressure wedge 42 is readily moved between the loading position of FIG. 1 to the closed or part forming position of FIG. 3*a* by a pair of actuators 60 mounted by brackets 62 to a support plate 64 fixed to base member 11. The actuators may be provided by hydraulic cylinders with rods 66 extending from internal pistons, which operatively extend through openings 67 in the upstanding leg 70 of the support block 52 into operative connection with the pressure wedge.

Figure 4:
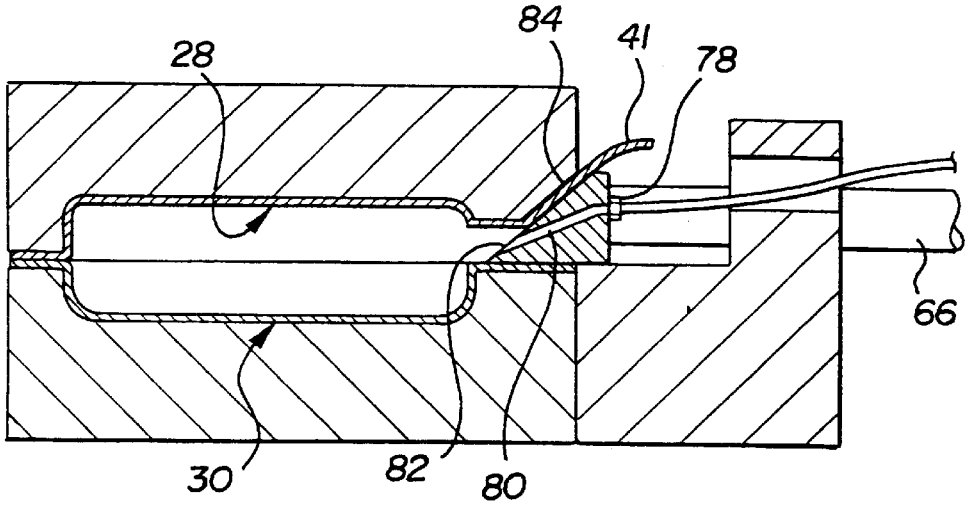
FIG. 4 is a cross sectional view similar to the cross sectional view of FIG. 3*a* showing the parts formed by the supply of pressurized air between the sheets in the closed forming dies.

Pressurized air or other inert gas for superplastic forming of the blanks 20, 22 is supplied into the equipment from a source such as a pressure regulating pump 72 supported on plate 64. The pump 72 has an output nozzle that operatively connects to a flexible hose 74 that leads through a passageway 75 in the support plates 64 and a passageway 76 in the upstanding leg 70 of support block 52 to a hose fitting 78 secured to the back wall of the pressure wedge 42. As best illustrated in the FIGS. 2*a*, 3*a* and 4, the air hose fitting 78 connects into internal airflow passage 80 that direct pressurized air though at least one discharge port 82 provided in the inclined face 84 of the pressure wedge 42 adjacent to the lower edge thereof. The discharge port 82 is strategically located so that it directs pressurized air into a sealed entrance provided between the upper and lower forming blank or sheets with the pressure wedge serving as an air seal or stopper that completes the perimeter fluid sealing of the blanks so that the pressurized air can readily stretch the heated blanks into the forming cavities of the upper and lower tools.

More particularly in a preferred embodiment, a robot 90 or other suitable loading unit turns and lowers the associated operating arm 92 thereof to grasp and pick up work 94, here a pair of blanks comprising upper and lower rectilinear forming blank 20, 22 from a stack 96. The long blank 20 of each pair of blanks is disposed atop the shorter blank 22 to facilitate proper loading into the forming dies. The robot and its arm operate to place the selected pair of blanks into the open press 10 and onto the lower forming, die 14. More particularly the shorter sheet 22 of the selected pair is positioned on the supporting top surface 48 of the lower die 14 so that the squared front or forward edge thereof abuts against the exposed square edge surface 96 of the support block 52 to accurately position the blank on the forming die for improved part formation. The forward edge of the longer blank drapes on the inclined face of the pressure wedge as illustrated.

Figure 2:
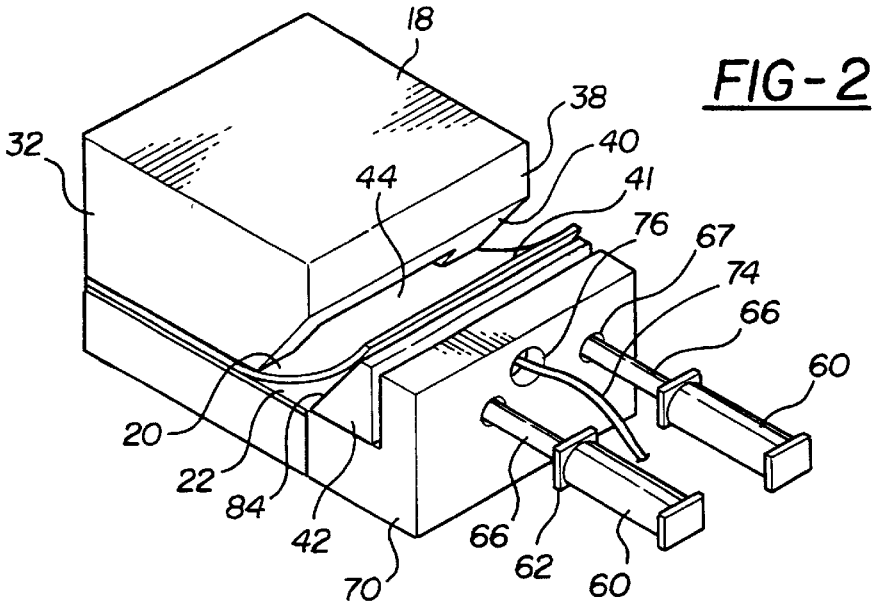
FIG. 2 is a pictorial view of upper and lower forming dies and associated pressurization wedge
Figure 2A:
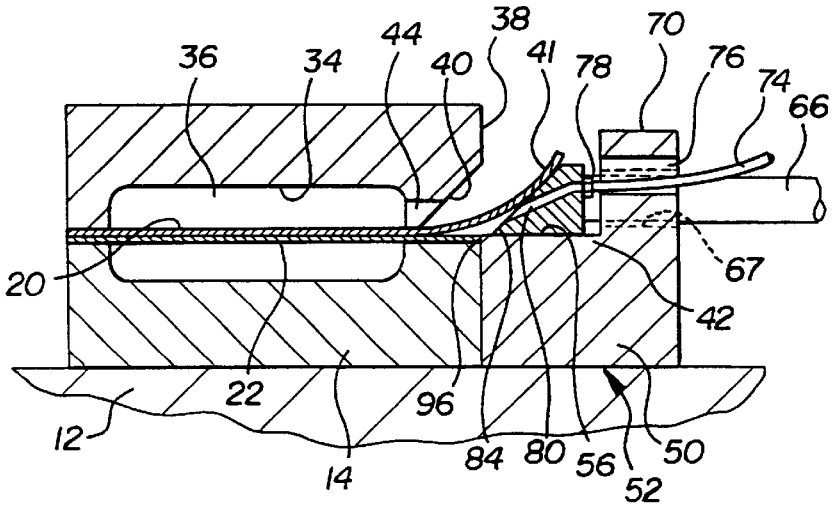
FIG. 2*a* is a cross sectional view of the construction of FIG. 2.

After the blanks are loaded and placed in the opened dies, the robot quickly moves to an out of way position. The heat energy of the blanks progressively increases and the two dies are subsequently closed to provide the peripheral force to complete a partial internal fluid seal at the interface areas of the blanks aligned with the peripheral surfaces of the dies as illustrated in FIGS. 2 and 2*a*.

As shown in these Figs the exposed surface of the shorter blank 22 aligns with the upper surface 56 of leg 50 of the support block to facilitate subsequent movement of the pressure wedge 42 to the closed position shown in FIGS. 3, 3*a*.

The two pistons 60 are then actuated so the piston rods power stroke outwardly of their cylinders to displace the pressure wedge to the closed position to lift and force the forward peripheral portion of the top blank 20 into tight engagement with the flattened and inclined blank contact surface of the top die 18. The lower blank is forced downwardly against the forward support surface of the lower forming die. With the pressure wedge in the operating position of FIGS. 3, 3*a*, a stopper-like air seal unit for the top and bottom blanks is provided that completes the internal perimeter sealing thereof. With the heat energy of the blanks increased to a lever sufficient for superplastic stretching, the sealed blanks are then stretched into the upper and lower dies by the force of pressurized air supplied into the sealed area between the blanks so that the parts are shaped to the profile of the dies.

In this invention, the exhaust port or pressure discharge port 82 of the pressure wedge is disposed at an interior position relative to the wedge sealing and is located so that pressurized gas can be injected between the two sheets and internally of the full perimeter seal provided between the blanks by the closing pressure of the upper and lower forming dies and closure of the pressure wedge 42.

The two parts 28, 30 are simultaneously superplastically and accurately formed and the upper tool is subsequently raised to expose the formed parts on the die. The arm 100 of a second robot 102 or other suitable unloading tool is moved into the opened forming equipment to pick up the hot formed parts 28, 30 that have accurate reproductions of the profile of the forming die. After removal, the parts are suitably stacked for subsequent cleaning, trimming or other finishing procedures so that they are ready for final delivery to an assembly area. The opened dies are then prepared for additional superplastic forming of pairs of discrete parts as described above.

While some preferred methods and mechanisms have been disclosed to illustrate this invention, other methods and mechanisms embracing this invention will now be apparent to those skilled in the art. Accordingly, the scope of the invention is to be considered limited only by the following claims.

What is claimed is:

1. Forming die equipment for the simultaneous superplastic forming of pairs of metallic blanks having forward end portions and overlaid with respect to one another to have a common interface into a plurality of separate and discrete parts of predetermined shapes, said die equipment comprising separate upper and lower forming dies, a mechanism including carrier plates for said dies and an associated motor for relatively moving said dies between an open position for loading one of said pairs of blanks therebetween and a closed position for the partial mechanically-loaded loaded perimeter sealing of said blanks at said interface thereby establishing a temporary pneumatic perimeter seal defining a major portion of a gas space within said interface, a support block fixed adjacent to said lower forming die, a pressure wedge having a gas passage therethrough and having a gas discharge port at the terminal end thereof, said pressure wedge being operatively mounted on said support block adjacent to said forming dies (and operatively mounted) for sliding movement thereon between an open position spaced from said forming dies and a closed position with respect to said forming dies and operatively between said forward end portions of said blanks to complete the perimeter seal and thereby the full encirclement and temporary pneumatic sealing of the gas space of said interface and to position said discharge port within said gas space so that pressurized gas can be subsequently injected therein to simultaneously stretch said pair of blanks in opposite directions into said forming dies to thereby plastically form said separate and discrete parts.

2. The forming die equipment of claim 1 wherein each of said pairs of blanks are defined by upper and lower flattened sheets of metal, said pressure wedge having an inclined forward closure face, said lower die having a peripheral wall providing support for said upper and lower sheets of each pair of blanks and providing the operative alignment of said lower sheet with said pressure wedge, said forward end portion of an upper sheet extending beyond said forward end portion of the lower of said sheets and onto said forward closure face of said wedge, a power mechanism for moving said wedge relative to said support block and into a blank sealing position whereby said pressure wedge is sealingly positioned between said pair of sheets, said wedge having a gas passage extending (thorough) therethrough and through said inclined closure face, said gas passage terminating in a (that terminates in said) gas discharge port which communicates directly with the sealed gas space between the overlaid blanks when said pressure wedge is moved into said blank sealing position.

3. Forming die construction for the simultaneous superplastic shaping of a pair of flattened sheet metal blanks overlaid with respect to one another to have overlapping forward end portions and a common interface into a plurality of separate and discrete parts of predetermined shapes, said die construction comprising upper and lower forming dies relatively movable from an open position for the loading of a pair of said overlaid sheet metal blanks therein to a closed position in which an interior temporary gas seal is established partially encompassing an inner gas space between said sheet metal blanks, a support block adjacent to said lower forming die, a sealing wedge operatively mounted on said support block at one side of said lower forming die for receiving the overlapping end portion of said uppermost sheet metal blanks and movable therefrom into a position between said sheet metal blanks and operable to cooperate with said dies to provide an augmenting gas seal between said blanks to close and complete the temporary gas sealing previously established between said sheet blanks on the closure of said upper and lower dies, and a gas passage in said sealing wedge for the passage of pressure gas therethrough to the inner gas space for the supply of pressurized gas thereto and the subsequent superplastic simultaneous formation of said plurality of discrete parts.

4. The construction of claim 3 wherein said blank sealing wedge is formed with an internal gas delivery passage which has a gas discharge port positioned internally of the temporary gas seal formed between said blanks for the delivery of pressurized gas to the gas space to thereby stretch the blanks onto forming surfaces of the upper and lower dies in a superplastic forming operation and thereby form said discrete parts.

5. Forming die equipment for the simultaneous superplastic forming of pairs of blank metal sheets overlaid with respect to one another to define a common interface and heated for superplastic forming into a plurality of separate parts of discrete predetermined shapes, said die equipment comprising a lower forming die, an upper forming die having a forward contact face, a support block and a die closure wedge having a closure face operatively mounted for sliding movement on said support block between an open position away from said upper and lower forming dies and a closed position operatively disposed between the upper and lower forming dies, said upper die having a forward contact face, said lower die having a peripheral wall providing a support for a pair of said metal sheets mounted thereon in said overlaid condition with respect to one another, an upper one of said blanks having an end extending beyond the end of said lower blank and onto said closure face of said die closure wedge, an actuator mechanism for moving said die closure wedge on said support block into a die closure position whereby said upper sheet is displaced into contact with the forward contact face of the upper die, said upper and lower dies cooperating to form a temporary internal gas seal between the blanks partially forming an internal sealed area therebetween, and said closure wedge being operative to displace said upper sheet into sealing engagement with said forward contact face of said upper die to complete said internal sealed area when in the closed position, a gas passage in said closure wedge that communicates with the internal sealed area between the blanks so that pressurized gas can be delivered therethrough to plastically stretch the blanks in opposite directions into the forming dies to thereby form said separate parts.

6. A method of superplastically and simultaneously forming pairs of sheet metal blanks of superplastic forming material having forward edge portions and being stacked closely together to define a common interface therebetween into a plurality of separate and discrete formed parts using upper and lower forming dies and a sealing wedge:

a. positioning a pair of said stacked sheet metal blanks of superplastic forming material onto one of said forming dies so that a forward edge portion of an upper sheet overlaps the forward edge portion of an associated lower sheet and the sealing wedge;

b. heating the forming dies so that the temperature of said pair of sheet metal blanks reaches a temperature for superplastic forming;

c. closing the upper and lower dies on the sheets to establish a partial gas tight seal at said common interface partially encompassing an internal chamber between said sheet metal blanks;

d. moving the sealing wedge to an operative position between said sheet metal blanks to complete the gas tight sealing of the internal chamber;

e. supplying pressurized gas into the internal chamber to increase the volume of said internal chamber to simultaneously effect the stretching of said sheet metal blanks into the upper and lower profiling dies and to thereby plastically form the sheet metal blanks into a plurality of parts having the profile of the forming dies;

f. opening the press, and breaking the gas tight seal;

g. removing the separate and discrete formed parts from the profiling dies.

7. The method of claim 6 wherein each of said pairs of sheet metal blanks comprises and upper and lower flattened sheets and further comprising the step of effecting the displacement of only said upper sheet with the sealing wedge and thereby positioning an air discharge passage associated with the sealing wedge inside of the sealed chamber between the upper and lower sheets.

* * * * *